US005807134A

United States Patent [19]

Hara

[11] Patent Number: 5,807,134

[45] Date of Patent: Sep. 15, 1998

[54] ELECTRICAL LAMP SOCKET ASSEMBLY

[75] Inventor: Kanichi Hara, Jordan, Hong Kong

[73] Assignee: Minami International Corp., Yonkers, N.Y.

[21] Appl. No.: 749,826

[22] Filed: Nov. 15, 1996

[51] Int. Cl.[6] ..... H01R 4/24; H01R 4/26; H01R 11/20

[52] U.S. Cl. ..... 439/419; 439/340

[58] Field of Search ..... 439/419, 340

[56] References Cited

U.S. PATENT DOCUMENTS

| | | | |
|---|---|---|---|
| 3,206,712 | 9/1965 | Schick et al. | 439/419 |
| 4,778,409 | 10/1988 | Maddock | 439/602 |
| 5,421,742 | 6/1995 | Huang | 439/419 |
| 5,474,467 | 12/1995 | Chen | 439/419 |
| 5,526,250 | 6/1996 | Ting et al. | 439/419 |
| 5,531,609 | 7/1996 | Cheng et al. | 439/419 |
| 5,586,904 | 12/1996 | Huang | 439/419 |
| 5,641,303 | 6/1997 | Chiu | 439/419 |

*Primary Examiner*—Gary F. Paumen
*Assistant Examiner*—Katrina Davis
*Attorney, Agent, or Firm*—Amster, Rothstein & Ebenstein

[57] ABSTRACT

In an electrical lamp socket assembly for receiving an externally threaded light bulb having a central longitudinal axis and providing electrical coupling to a pair of lead wires, the improvement wherein a central conductor extends through a transversely extending opening of an insulative bottom platform. The central conductor has a base portion having a piercing tab for contacting one of the pair of lead wires and a transversely extending, resiliently flexible strip portion. The strip portion has an end immediately extending from the base portion, an opposed free end disposed below the top of the bottom platform, and an upwardly-projecting, generally convexly curved intermediate segment connecting the strip portion ends, extending through and above the top of the bottom platform and through the central axis for defining a conductor for contacting a bottom-end conductor of the light bulb. The through opening in the bottom platform is configured and dimensioned to preclude passage therethrough of the base portion and the free end of the strip portion.

22 Claims, 7 Drawing Sheets

FIG. 1
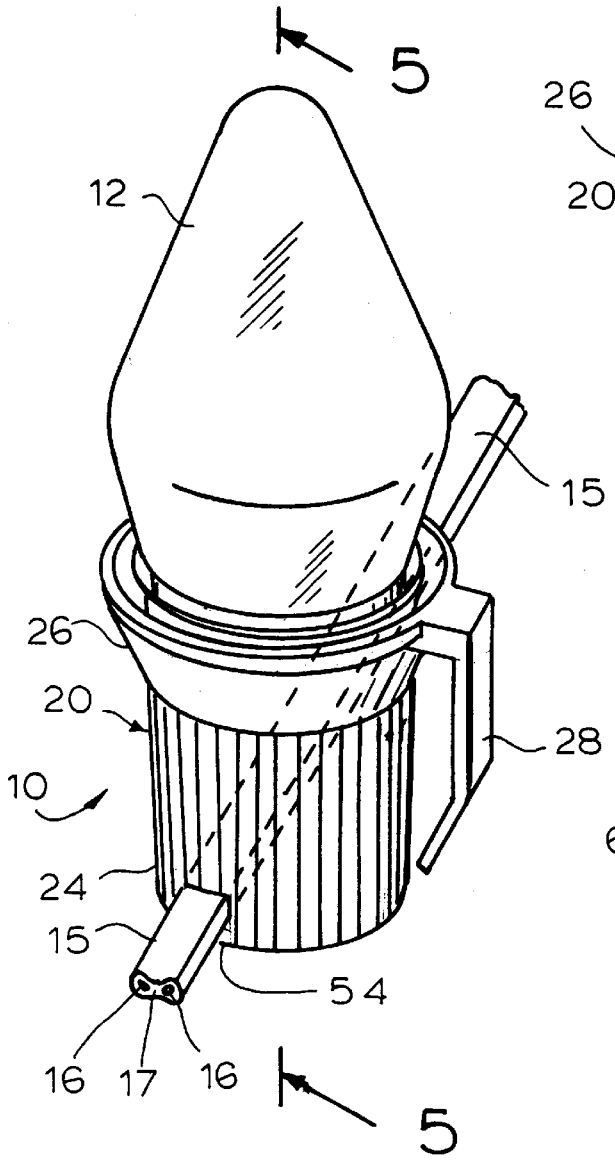
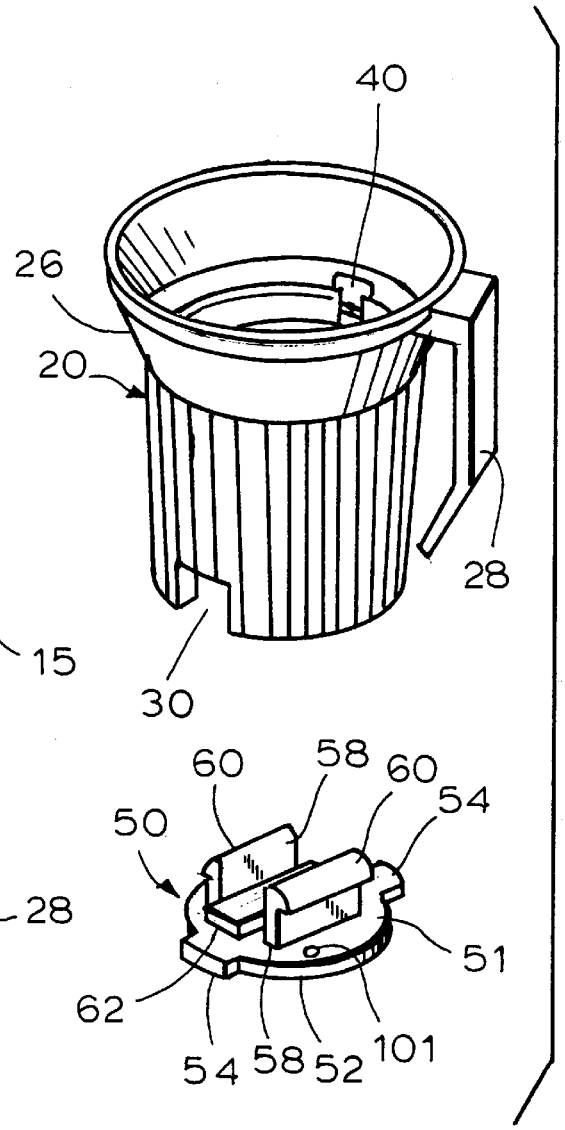
FIG 2

FIG. 3
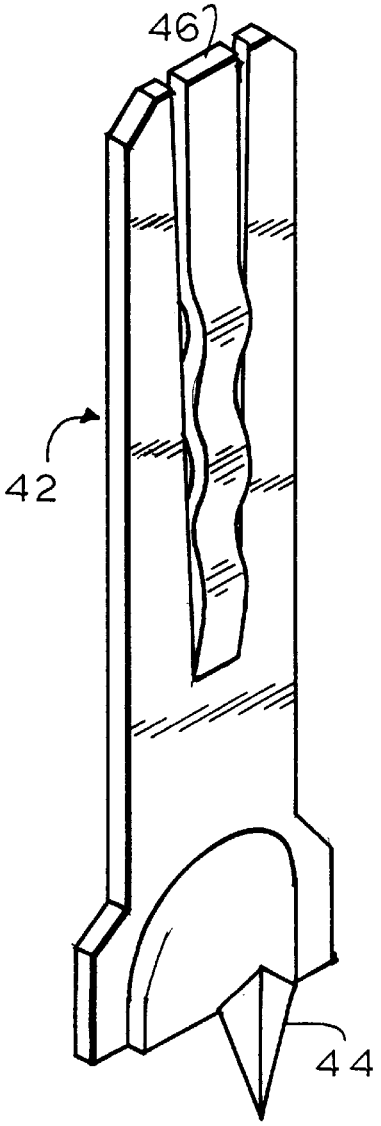
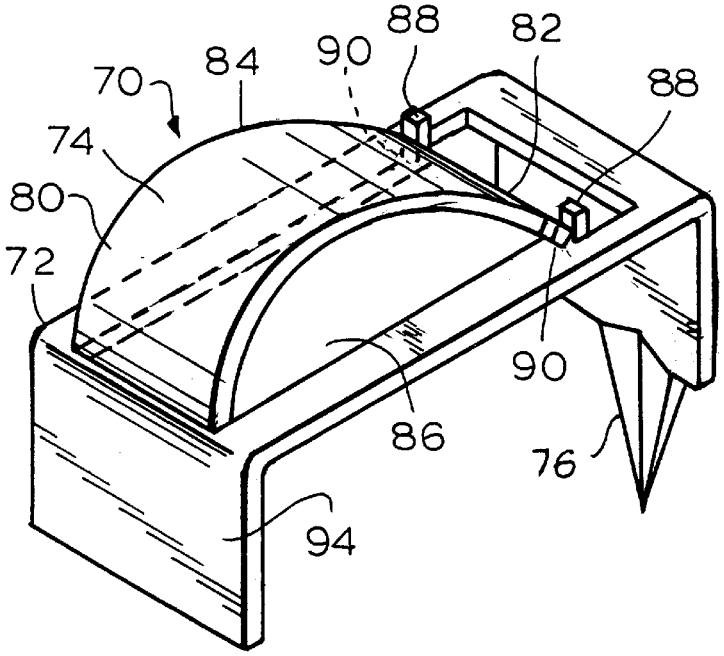
FIG. 4

ELECTRICAL LAMP SOCKET ASSEMBLY

BACKGROUND OF THE INVENTION

The present invention relates to an electrical lamp socket assembly for receiving an exteriorly threaded light bulb having a central longitudinally axis and providing electrical coupling to a pair of lead wires, and more particularly to such an assembly having unique safety features.

Various decorative string and Christmas tree light sets are well known and widely used everywhere in the world. The present invention has particular applicability to the electrical lamp socket assemblies used in such decorative light sets, but also a broad applicability to similar electrical lamp socket assemblies.

The lamp socket for a decorative string or Christmas tree light generally comprises an internally threaded plastic socket body, a plastic cap fastened to the socket body to hold down the lead wires, and two conductors (side and central conductors) mounted within respective holes on the socket body and disposed in electrical contact with respective lead wires. When the externally threaded lamp bulb is threaded into the socket body, the tip or bottom-end contact and the ring or side contact of the lamp bulb are respectively connected to the lead wires through the central and side conductors, respectively. More particularly, in one conventional assembly the central conductor extends upwardly through an opening of a bottom platform of the socket body. It has a base portion having a piercing tab for contacting one of the lead wires and a transversely extending, resiliently flexible strip portion. The strip portion has an end connected to the piercing tab and a free end extending above the top of the bottom platform and through the central axis for defining a central conductor for contacting a tip or bottom-end contact of the light bulb. In other words, the strip portion is cantilevered out from the base portion.

This construction has not proven to be entirely satisfactory in use. Such decorative strings and light sets may be used indoors or outdoors and may be used whether or not adults are in their immediate presence. Accordingly, safe operation of the assemblies is of paramount concern. While the strip portion appears to be adequately protected when the light bulb is in the assembly, attempts to forcibly insert the light bulb into, or remove the same from, the assembly may damage or at least move the strip portion (especially the free end thereof) so as to cause failure of the assembly. The relocated strip portion may be unable to properly contact the tip or bottom-end contact of the light bulb so that light bulb either won't light or, in extreme cases, the assembly is short circuited. The short circuiting of the assembly may occur either through direct physical contact between a mispositioned free end and the longitudinally extending side conductor or via the intermediary of a conductive portion of the light bulb or a fingertip.

Accordingly, it is the object of the present invention to provide an electrical lamp socket assembly wherein the central conductor is highly resistant to accidental displacement.

Another object is to provide such an assembly characterized by a high level of safety.

A further object is to provide such an assembly wherein the strip portion of the central conductor is blocked from being displaced into direct physical contact with the side conductor.

It is also an object of the present invention to provide such an assembly which is easy and economical to construct, use and maintain.

SUMMARY OF THE INVENTION

It has now been found that the above and related object of the present invention are obtained in an electrical lamp socket assembly for receiving an externally threaded light bulb having a central longitudinal axis and providing electrical coupling to a pair of lead wires. The assembly comprises an insulative socket including a longitudinally extending cylindrically contoured wall member, and a generally transversely extending bottom platform. The cylindrical wall member has an internally threaded surface to receive an externally threaded light bulb, a longitudinally extending groove formed in the internally threaded surface to receive a side conductor, and diametrically opposed recesses formed in a lower surface of the wall member to receive lead wires. The bottom platform is positioned adjacent a lower end of the wall member and disposed at an interior perimeter thereof. The bottom platform has a transversely extending groove formed in a lower surface thereof for receipt of a pair of lead wires therein, and a transversely extending through opening formed therethrough adjacent the central axis of the light bulb.

The assembly also comprises side and central conductors. The longitudinally extending side conductor is at least partially disposed within the longitudinally extending groove of the wall member for contacting a side contact of the light bulb, the side conductor having at its lower end a piercing tab for contact with a first one of the pair of lead wires at a location transversely displaced from the central axis. The central conductor extends through the through opening of the bottom platform and has a base portion having a piercing tab for contact with a second one of the pair of lead wires and a transversely extending resiliently flexible strip portion. The strip portion has an end immediately extending from the base portion, an opposed free end disposed below the top of the bottom platform, and an upwardly-projecting, generally convexly curved intermediate segment connecting the strip portion ends, extending through and above the top of the bottom platform and through the central axis for defining a central conductor for contacting a bottom-end contact of the light bulb.

The assembly further includes a circularly contoured bottom cap member having an upper surface for mating with the lower end of the wall member. The bottom cap member includes a diametrically extending raised rib portion and two opposing longitudinally extending retaining members formed on the upper surface thereof. The diametrically extending raised rib portion is configured and dimensioned to press lead wires upwardly and securely into the transversely extending groove of the bottom platform and into electrical contact with the piercing tabs of the side and central conductors. The opposing longitudinally extending retaining members are received through respective openings formed in the bottom platform to lockingly engage the bottom platform.

Preferably the through opening in the bottom platform is configured and dimensioned to preclude passage therethrough of the base portion and the free end of the strip portion, thereby to maintain the base portion and the free end of the strip portion below the bottom platform and to limit upward movement of the intermediate segment of the strip portion therethrough.

In a preferred embodiment, the free end of the strip portion is configured and dimensioned to preclude passage through the through opening in the bottom platform. In other words, the free end is enlarged in width relative to the through opening to limit upward movement of the flexible strip. The intermediate segment is biased upwardly above the top of the bottom platform, preferably by the end extending from the base portion. The strip portion is preferably cut out of the base portion in a single stamping operation to define a transversely extending aperture in the base portion, the piercing tabs being disposed adjacent opposite ends of the transversely extending aperture. The free end of the strip portion is remote from the side conductor and the end thereof immediately extending from the base portion is relatively proximate to the side conductor.

In a preferred embodiment, the strip portion is cut out of the base portion in a single stamping operation to define an aperture therethrough, the free end being enlarged in width relative to the intermediate segment. The base portion further defines stop means upstanding therefrom for limiting forward transverse movement of the free end, thereby to preclude the strip portion from assuming a flat configuration, the stop means being formed in the single stamping operation. The bottom platform is configured and dimensioned to maintain the stop means upstanding from the base portion.

The present invention also encompasses a conductor adapted to extend upwardly through a transversely extending through opening in a support. The conductor comprises base and strip portions. The base portion has an aperture therethrough and a piercing tab for contacting a lead wire. The strip portion extends transversely and is resiliently flexible. It has an end immediately extending from the base portion, an opposed free end, and an upwardly-projecting, generally convexly curved intermediate segment connecting the strip portion ends. The strip portion is cut out of the base portion in a single stamping operation to define an aperture therethrough.

In a preferred embodiment the intermediate segment is biased upwardly by the end immediately extending from the base portion. The base portion further defines stop means upstanding therefrom for limiting forward movement of the free end, thereby to reclude the strip portion from assuming a flat configuration, the stop means being formed in the single stamping operation. The base portion and the free end are configured and dimensioned to preclude passage thereof through the support opening, thereby to maintain the base portion and the free end below the support. The free end is enlarged in width relative to the support opening, thereby to limit upward movement of the flexible strip therethrough.

BRIEF DESCRIPTION OF THE DRAWINGS

The above and related objects, features and advantages of the present invention will be more fully understood by reference to the following detailed description of the presently preferred, albeit illustrative, embodiments of the present invention when taken in conjunction with the accompanying drawing wherein:

FIG. 1 is an isometric view of an assembly according to the present invention, with a light bulb inserted thereinto and a pair of lead wires extending therethrough;

FIG. 2 is an exploded isometric view showing the cylindrically contoured wall member and the bottom cap member;

FIG. 3 is an isometric view, to an enlarged scale, of the first or side conductor;

FIG. 4 is an isometric view, to an enlarged scale, of the second or central conductor;

DETAILED DESCRIPTION OF THE PREFERRED EMBODIMENTS

Figure 5:
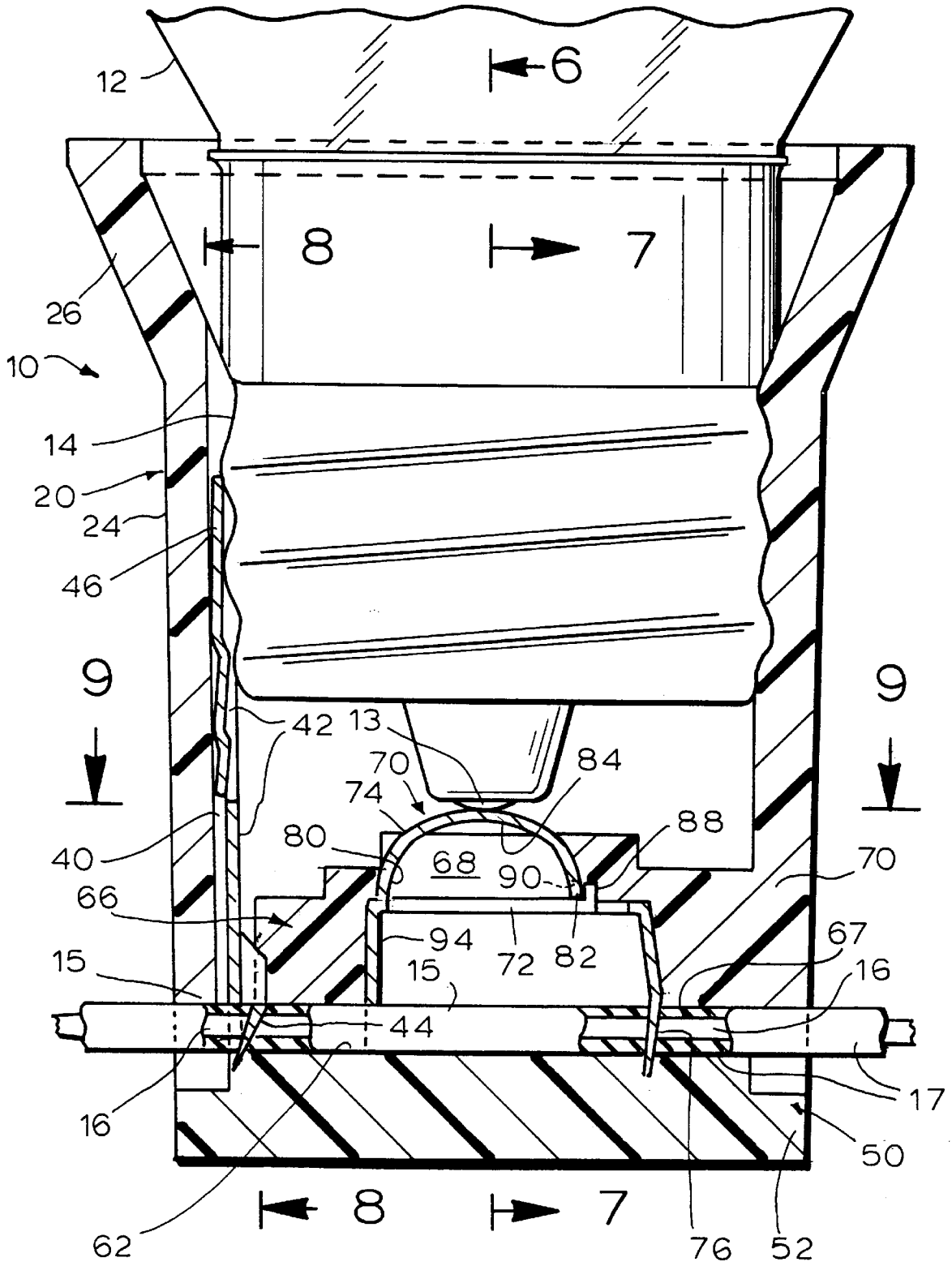
FIG. 5 is a sectional view, to an enlarged scale, taken along the line 5—5 of FIG. 1.

Referring now to FIG. 1, therein illustrated is an electrical lamp socket assembly according to the present invention, generally designated by the reference numeral 10. An externally threaded light bulb 12 having a central longitudinal axis, a side contact 14 and a bottom-end (tip) or central contact 13, is threadedly received within an internally threaded surface of the assembly. The assembly provides electrical coupling to a power supply 15 represented by a pair of lead wires 16 encased in insulation 17.

It will be appreciated that assembly 10 may be used in the upright position illustrated in FIG. 1 or in an inverted position.

Referring now to FIG. 2, and in particular the upper half thereof, therein illustrated is the socket body, generally designated 20. In its conventional aspects, the socket body 20 includes a longitudinally extending, generally cylindrically contoured wall member 24 and an upwardly and outwardly flared wall member 26 disposed thereabove and configured and dimensioned to receive the corresponding flare of the light bulb 12. A grip or handle 28 extends downwardly from the top of the flare 26 for a major length of the socket body 20. As best seen in FIG. 5, the interior of the cylindrical wall 24 is internally threaded to receive the externally threaded base of light bulb 12. The base of the cylindrical wall 24 defines a pair of diametrically opposed, upwardly projecting recesses 30 configured and dimensioned to receive the power supply 15 (including the pair of wires 16 and insulation 17).

Figure 6:
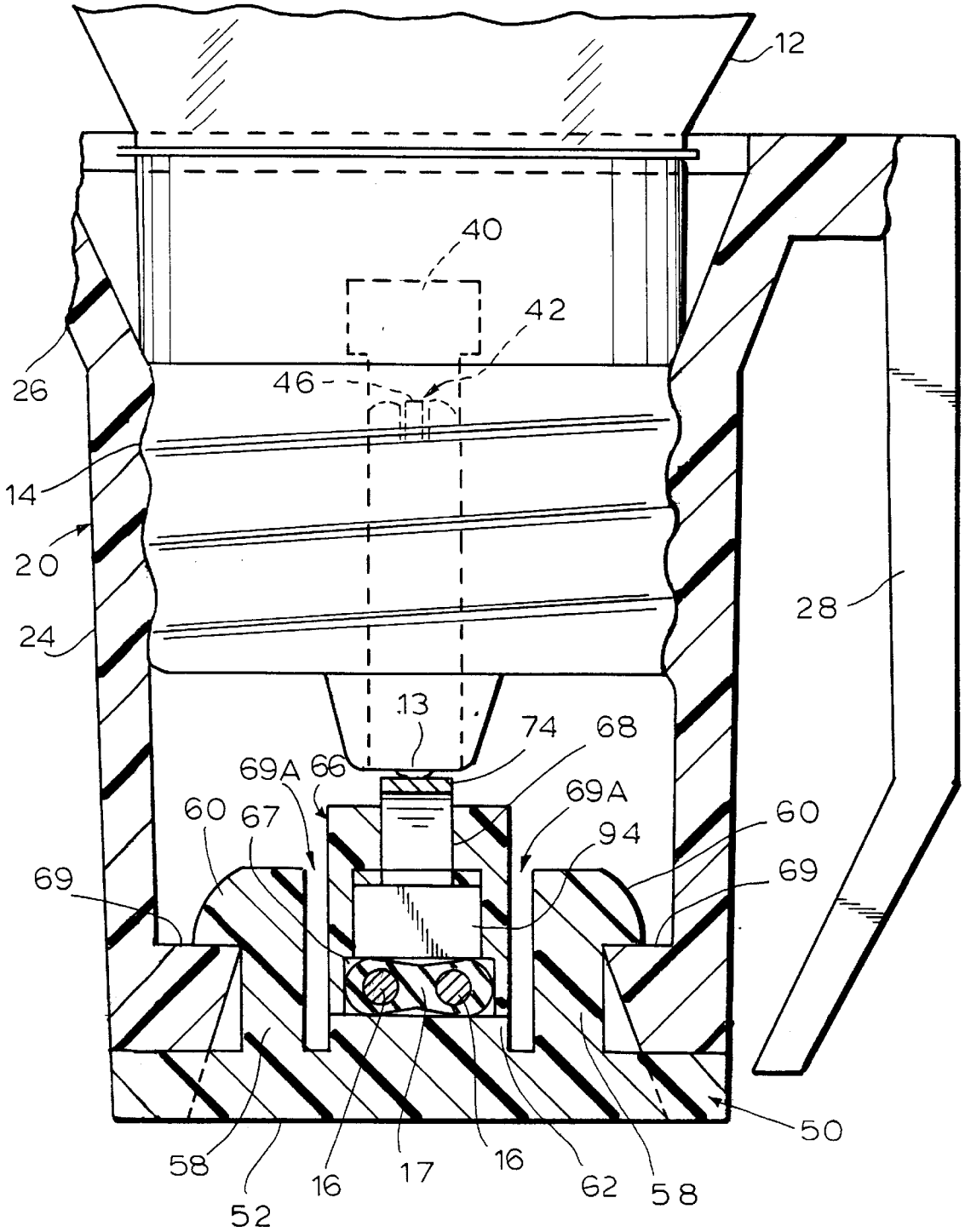
FIGS. 6, 7, 8 and 9 are sectional views taken along the lines 6—6, 7—7, 8—8, and 9—9, respectively, of FIG. 5.
Figure 7:
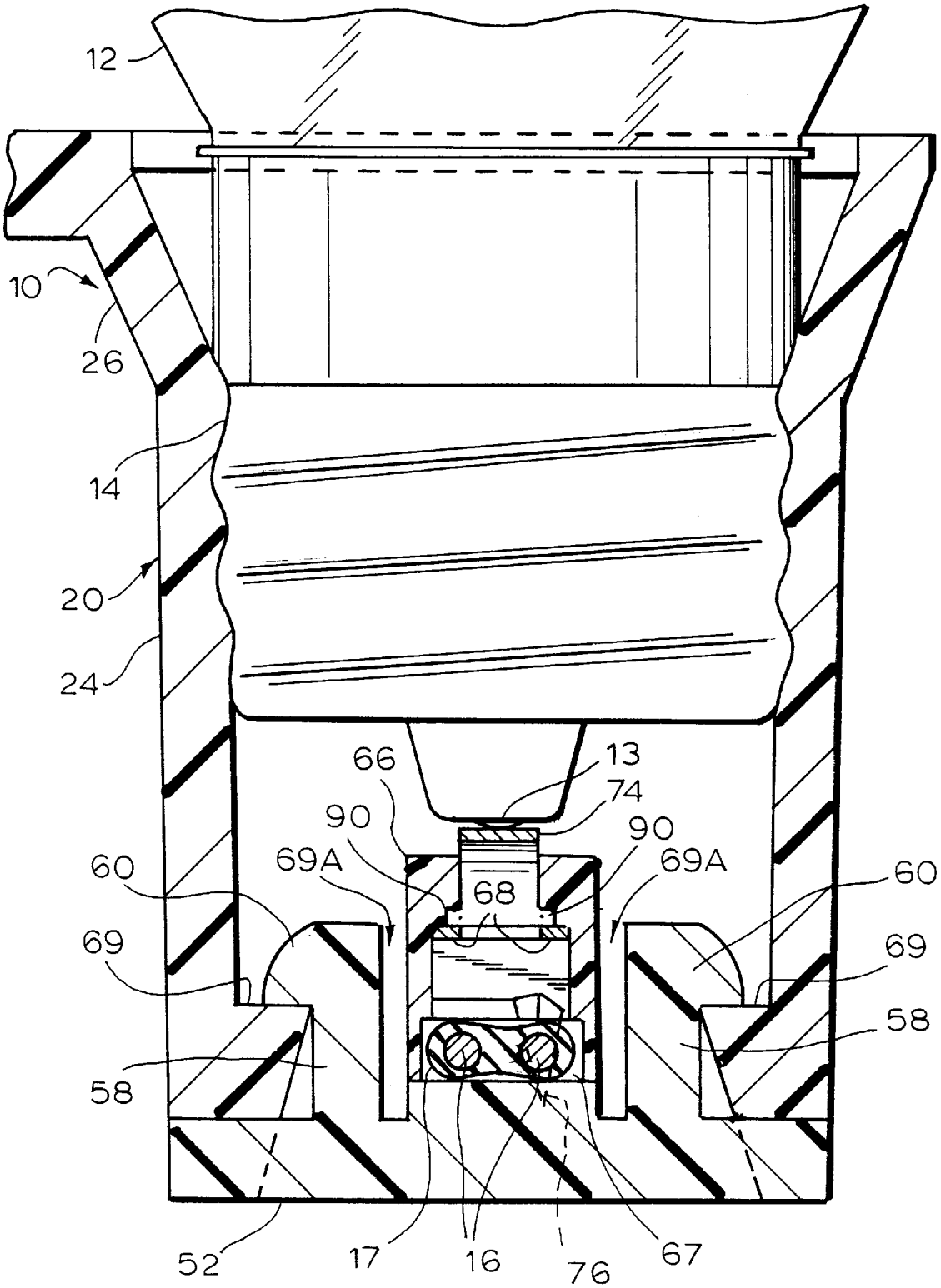
Figure 8:
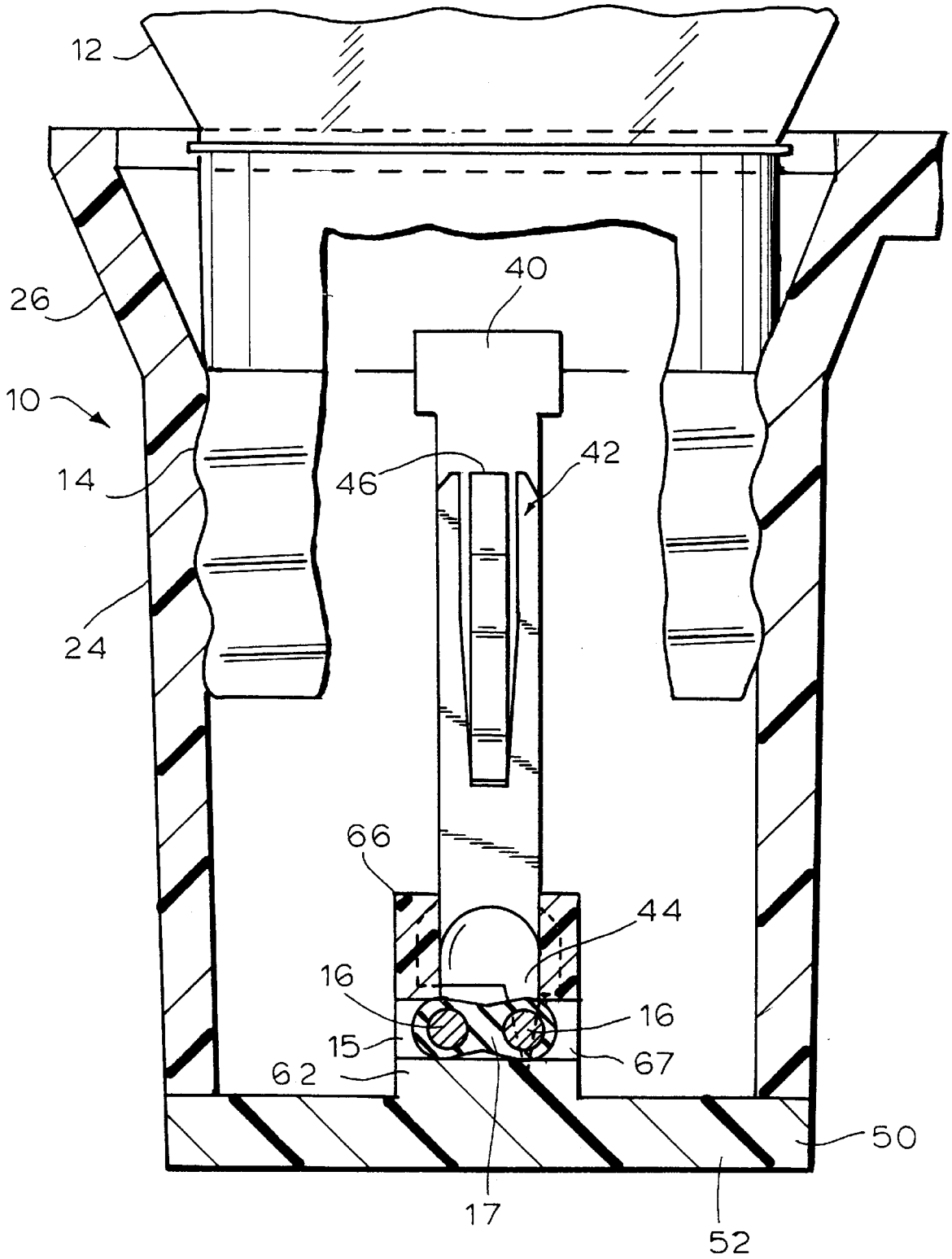
Figure 9:
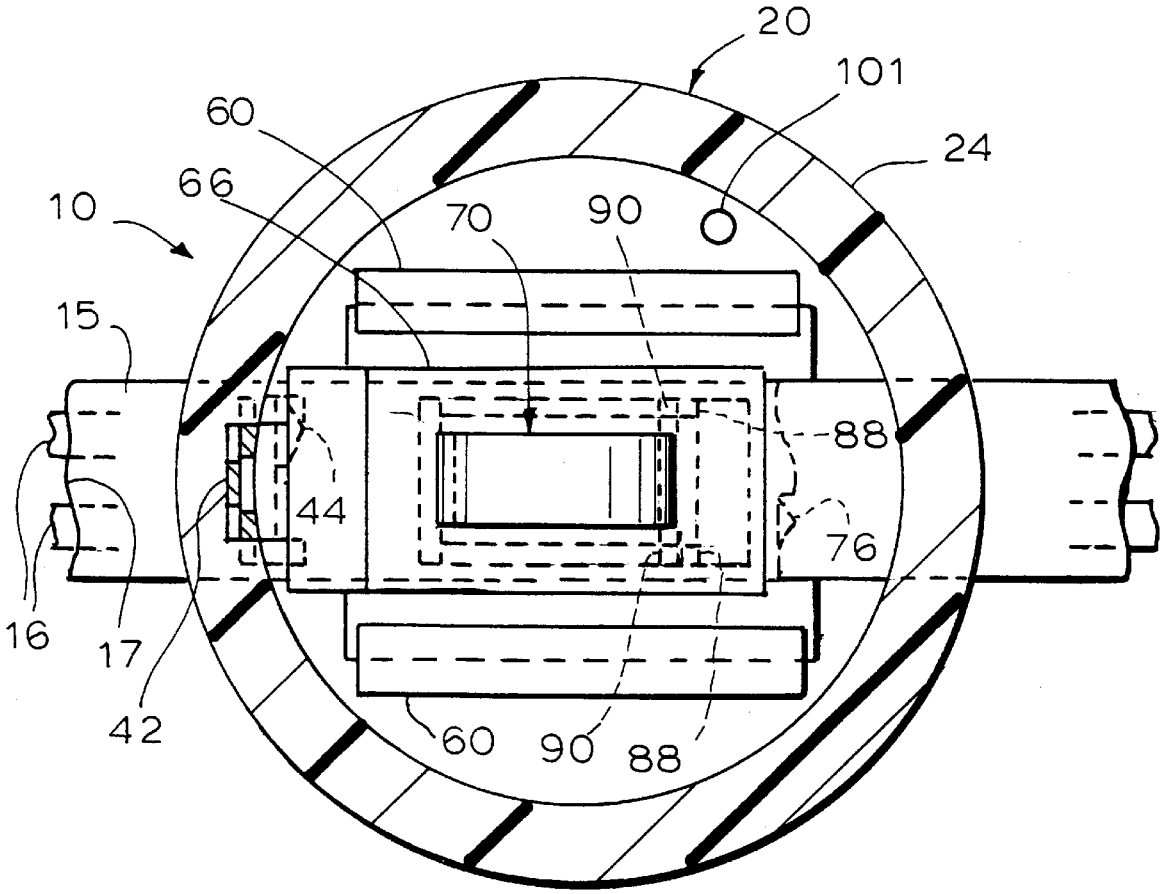
Figure 10:
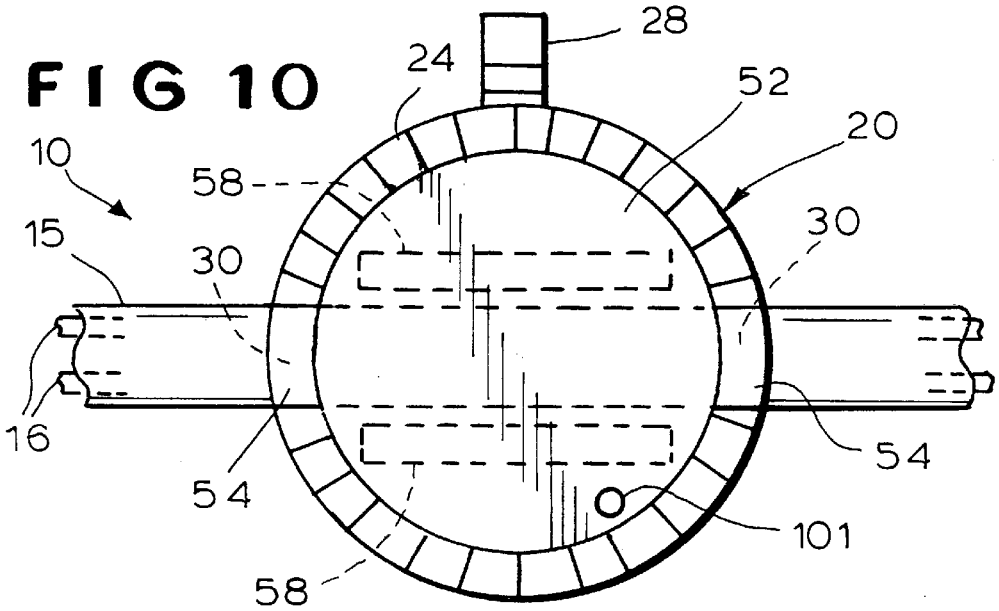
FIG. 10 is a bottom plan view of the assembly.

Referring now to FIGS. 5, 6 and 8, the inner surface of the cylindrical wall 24 defines a longitudinally extending, open-ended groove 40 which is configured and dimensioned to receive and hold a side conductor, generally designated 42. As best seen in FIG. 3, the side conductor 42 is at least partially disposed within the longitudinally extending groove 40 of the cylindrical wall 24. The side conductor 42 has at its lower end a piercing tab 44 for penetrating the insulation 17 and making physical and electrical contact with one of the lead wires 16 at a location transversely displaced from the central longitudinal axis of the assembly (i.e., the common central axis of the light bulb 12 and socket body 20). The side conductor 42 has at its upper end a resilient central tine 46 which is cut away on both sides from the remainder of the side conductor 42 and is slightly crimped to facilitate the establishment of electrical contact between the side conductor 42 of the assembly 10 and the side contact 14 of the light bulb 12.

Returning now to FIG. 2, and in particular the bottom half thereof, therein illustrated is the circularly contoured bottom cap member generally designated 50. In its conventional aspects, the bottom cap 50 has an upper surface 51 for mating with the lower end of the cylindrical wall 24, while allowing passage of power supply 15 (including the lead wires 16 and insulation 17) through the pair of opposed recesses 30. The bottom cap 50 includes a circular portion 52 adapted to fit within the interior of the cylindrical wall 24 of the socket body 20 and a pair of outwardly projecting, diametrically opposed tabs 54 which are received in the opposed recesses 30 immediately below the wires 16 and insulation 17 passing therethrough.

The bottom cap 50 includes a pair of vertically extending lugs 58 having the bottom ends thereof upstanding from the upper surfaces 51 of the cap 50 and the free ends thereof turned outwardly (that is, away from each other) to define locking flanges 60. The two opposed lugs 58 and their respective flanges 60 act as opposing longitudinally extending retaining members formed on the upper surface 51 of the circular portion 52 for locking engaging with the socket body 20. The lugs 58 are laterally spaced, thereby to enable passage of the wires 16 and insulation 17 from one recess 30, between the lugs 58, to the other recess 30. A diametrically extending raised rib portion 62 is formed on the upper surface 51 of the bottom cap 50 disposed between and parallel to the lugs 58. The raised rib portion 62 presses the lead wires 16 and insulation 17 upwardly into secure physical and electrical contact with the piercing tab 44 of the side conductor 42 and the piercing tab of the central conductor, respectively.

The bottom platform, generally designated 66, is part of the insulative socket body 20 at an interior perimeter thereof, and is disposed adjacent a lower end of the cylindrical wall 24. The bottom platform 66 extends along the same diameter as the lead wires 16 and insulation 17, but thereabove. The bottom platform 66 defines a transversely extending groove 67 formed in a lower surface thereof for receipt of such lead wires 16 and insulation 17 therein. Additionally, the bottom platform defines a transversely extending through opening 68 formed therethrough adjacent the common central axis of the socket body 20 and light bulb 12. The through opening 68 is preferably rectangular in configuration.

The bottom platform 66 additionally defines a pair of shoulders 69 projecting inwardly from the interior perimeter of the socket cylindrical wall 24 and a pair of transversely extending apertures 69A therethrough. Each aperture 69A is disposed on a respective side of the lead wires 16 and insulation 17. When the bottom cap 50 is inserted into the bottom end of the socket body 20, the upstanding lugs 58 (with their locking flanges 60) are initially cammed inwardly and then allowed to return to their original position, but now with the flanges 60 lying over the socket body shoulders 69 and maintaining the end cap 50 in position in the socket body 20. In this position, the diametrically extending raised rib portion 62 (disposed intermediate the two opposing longitudinally extending retaining lugs 58) presses the lead wires 16 and insulation 17 upwardly and securely into the transversely extending groove 67 of the bottom platform 66 and into electrical contact with the piercing tabs 44, 76 of the side and central conductors 42, 70.

Turning now to the novel aspects of the assembly 10, and referring now to FIGS. 4 and 5 in particular, the central conductor, generally designated 70, is designed to provide electrical communication between the central or bottom-end (tip) contact 13 of the light bulb 12 and one lead wire 16 just as the side conductor 42 is designed to provide electrical communication between the side contact 14 of the light bulb 12 (via tine 46) and the other lead wire 16. Thus, the central conductor 70 of assembly 10 extends through the through opening 68 in the bottom platform 66 of the socket body 20. The central conductor 70 has a base portion 72 and a transversely extending resiliently flexible strip portion 74. The base portion 72 includes a piercing tab 76 for contact with a second one of the pair of lead wires 16. The strip portion 74 extends transversely and is resiliently flexible. The strip portion 74 has one end 80 immediately extending from the base portion 72, an opposed free end 82 disposed below the top of the bottom platform 66, and an upwardly-projecting, generally convexly curved intermediate segment 84 which connects the ends 80, 82. The intermediate segment 84 extends through the through opening 68 in the bottom platform 66, above the top of the bottom platform, and passes through the common central longitudinal axis of the socket body 20 and lamp 12.

It will be appreciated that, for pedagogical purposes, the degree of curvature and the overall length of the strip portion 74 have been greatly exaggerated in the drawings.

The structure of the central conductor 70 is best understood by keeping in mind that, for reasons of manufacturing economy, typically the transversely extending T-shaped strip portion 74 is cut out of the base portion 72 in a single stamping operation, thereby to define a transversely extending T-shaped aperture 86 in the base portion 72. The piercing tabs 44 and 76 are disposed adjacent opposite ends of the transversely extending aperture 86. As best seen in FIG. 5, the piercing tab 44 of the side conductor 42 is disposed adjacent one end of the transversely extending aperture 86 while the piercing tab 76 of the central conductor 70 is disposed adjacent the opposite end of the transversely extending aperture 86. Preferably, the free end 82 of the strip portion 74 is remote from the side conductor tab 44, and the end 80 thereof immediately extending from the base portion is relatively proximate the central conductor tab 76.

The base portion 72 defines a pair of upstanding stop means 88, such as lugs, for limiting forward transverse movement of the free end 82 towards the tab 76. The free end 82 is enlarged in width relative to the flexible segment 84 to define wings 90 projecting outwardly on both sides. As illustrated in FIG. 4, the wings 90 of the free end 82 typically abut against the stop lugs 88 of the base portion 72 thereby to preclude the strip portion 74 from assuming a flat configuration (for example, in response to a bulb which has been over-tightened so that it depressed the resilient strip intermediate segment 84). The stop means 88 are formed in the same stamping operation as the strip portion 74. The upstanding stop lugs 88 are maintained in position by the contour of the top surface of the bottom platform 66, which contour is configured and dimension to maintain the stop lugs 88 upstanding from the base portion 72.

It will be appreciated that the wings 90 extend laterally outwardly from the free end 82 preferably by at least the lateral width of the stop lugs 88. The height of the lugs 88 combined with the height of the wings 90 is such as to fill the enlarged width portions of the T-shaped aperture 86, since the stop lugs 88 are bent up from such extended width portions and the wings 90 are cut out from such extended width portions.

To further stabilize the base portion 72 within the bottom platform 66 of the socket body 20, the end of the base portion 72 opposite the tab 76 may be provided with a downwardly depending flange 94.

The bottom platform 66 does not interfere with the passage of the piercing tab 44 of side conductor 42 through the side groove 40 downwardly into one of the lead wires, and the central conductor 70, as noted before, extends through the through opening 68 of the bottom platform 66. More particularly, the flange 94 of the central conductor 70 is disposed at one end of the through opening 68 and maintained therein against upward displacement by a lip extending thereover. The piercing tab 76 of the central conductor 70 is disposed at or adjacent the other end of the through opening 68. The upper portion of the through opening 68 is preferably shorter than the bottom portion. The through opening 68 receives adjacent one end thereof the flange 94 of the base portion 72, and at the other end thereof the free end 82 of the strip portion 74. The free end 82 of the strip portion 74 is enlarged in width relative to the through opening 68 to limit upward movement of the free end 82 of the strip portion 74 through the through opening 68. It will be appreciated that the strip portion free end 82 is able to retreat towards the attached end 80, but is blocked from advancing away therefrom by the stop lugs 88 projecting upwardly from the base portion 72 and abutting the wings 90 of the free end 82. The intermediate segment 84 is thus maintained in a generally convexly curved and upwardly projecting configuration such that it extends through and above the top of the bottom platform 66 and through the common central axis of the socket body 20 and the light bulb 12, thereby providing a central conductor means for contacting a bottom-end or central contact 13 of the light bulb 12.

A critical feature of one preferred embodiment of the present invention is that the through opening 68 of the bottom platform 66 is configured and dimensioned to preclude passage therethrough of the base portion 72 and the free end 82 of the strip portion 74, thereby to maintain both the base portion 72 and the free end 82 of the strip portion 74 below (or within) the bottom platform 66. As a result, because both ends of the strip portion 74 are precluded from upward movement, both during insertion and use, the bottom platform 66 limits upward movement of the intermediate segment 84 of the strip portion 74 as well.

The bottom cap 50 is preferably provided with a small aperture 101 extending therethrough so that, when the assembly 10 is used in the upright position, if water seeps into the socket through the bulb/socket interface 12/20, it will naturally discharge itself through the aperture 101 before it can accumulate and thereby create a short circuit.

To summarize, the present invention provides an electrical lamp socket assembly wherein the central conductor is highly resistant to accidental displacement, the strip portion of the central conductor being blocked from being displaced into direct physical contact with the side conductor. The assembly is characterized by a high level of safety and is easy and economical to construct, use and maintain.

Now the preferred embodiments of the present invention as shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. An electrical lamp socket assembly for receiving an externally threaded light bulb having a central longitudinal axis and providing electrical coupling to a pair of lead wires, comprising:

(A) an insulative socket including (i) a longitudinally extending cylindrically contoured wall member, said wall member having an internally threaded surface to receive an externally threaded light bulb, a longitudinally extending groove formed in said internally threaded surface to receive a longitudinally extending side conductor, and diametrically opposed recesses formed in a lower surface of said wall member to receive lead wires;

(ii) a generally transversely extending bottom platform positioned adjacent a lower end of said wall member and mounted at an interior perimeter thereof, said bottom platform having a transversely extending groove formed in a lower surface thereof for receipt of a pair of lead wires therein, said bottom platform having a transversely extending through opening formed therethrough adjacent said central axis of the light bulb;

(B) the longitudinally extending side conductor at least partially disposed within said longitudinally extending groove of said wall member for contacting a side contact of the light bulb, said side conductor having at its lower end a piercing tab for contact with a first one of said pair of lead wires at a location transversely displaced from said central axis;

(C) a central conductor extending through said through opening of said bottom platform and having a base portion having a piercing tab for contact with a second one of said pair of lead wires and a transversely extending, resiliently flexible strip portion, said strip portion having an end immediately extending from said base portion, an opposed free end disposed below the top of said bottom platform, and an upwardly-projecting, generally convexly curved intermediate segment connecting said strip portion ends, extending through and above the top of said bottom platform and through said central axis for defining said central conductor for contacting a bottom-end contact of the light bulb; and (D) a circularly contoured bottom cap member having an upper surface for mating with said lower end of said wall member, said bottom cap member including a diametrically extending raised rib portion and two opposing longitudinally extending retaining members formed on said upper surface thereof, said diametrically extending raised rib portion being configured and dimensioned to press lead wires upwardly and securely into said transversely extending groove of said bottom platform and into electrical contact with said piercing tabs of said side and central conductors, said opposing longitudinally extending retaining members being received through respective openings formed in said bottom platform to lockingly engage said bottom platform.

2. The assembly of claim 1 wherein said through opening in said bottom platform is configured and dimensioned to preclude passage therethrough of said free end.

3. The assembly of claim 1 wherein said intermediate segment is biased upwardly above the top of said bottom platform.

4. The assembly of claim 1 wherein said intermediate segment is biased upwardly above the top of said bottom platform by said end extending from said base portion.

5. The assembly of claim 1 wherein said strip portion is cut out of said base portion in a single stamping operation to define a transversely extending aperture in said base portion.

6. The assembly of claim 5 wherein said piercing tabs are disposed adjacent opposite ends of said transversely extending aperture.

7. The assembly of claim 1 wherein said free end of said strip portion is remote from said side conductor and said end thereof immediately extending from said base portion is relatively proximate to said side conductor.

8. The assembly of claim 1 wherein said strip portion is cut out of said base portion in a single stamping operation to define an aperture therethrough.

9. The assembly of claim 8 wherein said free end is enlarged in width relative to said intermediate segment.

10. The assembly of claim 9 wherein said base portion further defines stop means upstanding therefrom for limiting forward transverse movement of said free end, thereby to preclude said strip portion from assuming a flat configuration, said stop means being formed in said single stamping operation.

11. The assembly of claim 10 wherein said bottom platform is configured and dimensioned to maintain said stop means upstanding from said base portion.

12. The assembly of claim 1 wherein said through opening in said bottom platform is configured and dimensioned to preclude passage therethrough of said base portion and said free end of said strip portion, thereby to maintain said base portion and said free end of said strip portion below said bottom platform and to limit upward movement of said intermediate segment of said strip portion therethrough.

13. The assembly of claim 1 wherein said free end is enlarged in width relative to said through opening to limit upward movement of said flexible strip portion.

14. An electrical lamp socket assembly for receiving an externally threaded light bulb having a central longitudinal axis and providing electrical coupling to a pair of lead wires, comprising:

(A) an insulative socket including:

(i) a longitudinally extending cylindrically contoured wall member, said wall member having an internally threaded surface to matingly receive said externally threaded light bulb, said wall member having a longitudinally extending groove formed in said internally threaded surface to receive a longitudinally extending side conductor, and diametrically opposed recesses formed in a lower surface of said wall member to receive lead wires;

(ii) a generally transversely extending bottom platform positioned adjacent a lower end of said wall member and mounted at an interior perimeter thereof, said bottom platform having a transversely extending groove formed in a lower surface thereof for receipt of a pair of lead wires therein, the lead wires extending through said bottom platform having a generally rectangular, transversely extending through opening formed therethrough adjacent said central axis of the light bulb;

(B) the longitudinally extending side conductor at least partially disposed within said longitudinally extending groove of said wall member for contacting a side contact of the light bulb, said side conductor having at its lower end a piercing tab for contact with a first one of said pair of lead wires at a location transversely displaced from said central axis;

(C) a central conductor extending through said through opening of said bottom platform and having a base portion having a piercing tab for contacting with a second one of said pair of lead wires and a transversely extending resiliently flexible strip portion cut out of said base portion in a single stamping operation to define a transversely extending aperture, said strip portion having an end immediately extending from said base portion, an opposed free end disposed below the top of said bottom platform, and an upwardly-projecting, generally convexly curved intermediate segment connecting said strip portion ends, extending through and above the top of said bottom platform and through said central axis for defining said central conductor for contacting a bottom-end contact of the light bulb, said intermediate segment being biased upwardly above the top of said bottom platform by said end immediately extending from said base portion, said piercing tabs being disposed adjacent opposite ends of said transversely extending aperture; and (D) a circularly contoured bottom cap member having an upper surface for mating with said lower end of said wall member, said bottom cap member including a diametrically extending raised rib portion and two opposing longitudinally extending retaining members formed on said upper surface thereof, said diametrically extending raised rib portion being configured and dimensioned to press lead wires upwardly and securely into said transversely extending groove of said bottom platform and into electrical contact with said piercing tabs of said side and central conductors, said opposing longitudinally extending retaining members being received through respective openings formed in said bottom platform to lockingly engage said bottom platform.

15. The assembly of claim 14 wherein said free end is enlarged in width relative to said intermediate segment and said through opening to limit upward movement of said flexible strip; said base portion further defining stop means upstanding therefrom and limiting forward transverse movement of said enlarged free end, thereby to preclude said strip portion from assuming a flat configuration, and said base portion and said enlarged free end being configured and dimensioned to preclude passage thereof through said through opening in said bottom platform, thereby to maintain said base portion and said enlarged free end below said bottom platform.

16. The assembly of claim 14 wherein said free end of said strip portion is remote from said side conductor and said end thereof immediately extending from said base portion is relatively proximate to said side conductor.

17. A conductor adapted to extend upwardly through a transversely extending through opening in a support, said conductor comprising:

(A) a base portion having an aperture therethrough and a piercing tab for contacting a lead wire; and (B) a transversely extending resiliently flexible strip portion having:

(i) an end immediately extending from said base portion, (ii) an opposed free end, and (iii) an upwardly-projecting, generally convexly curved intermediate segment connecting said strip portion ends;

said strip portion being cut out of said base portion in a single stamping operation to define an aperture therethrough.

18. The conductor of claim 17 wherein said intermediate segment is biased upwardly by said end immediately extending from said base portion.

19. The conductor of claim 17 wherein said base portion further defines stop means upstanding therefrom for limiting forward movement of said free end, thereby to preclude said strip portion from assuming a flat configuration, said stop means being formed in said single stamping operation.

20. The conductor of claim 17 wherein said base portion and said free end are configured and dimensioned to preclude passage thereof through an opening in the support, thereby to maintain said base portion and said free end below the support.

21. The conductor of claim 17 wherein said free end is enlarged in width relative to said opening in the support, thereby to limit upward movement of said flexible strip portion therethrough.

22. A conductor adapted to extend upwardly through a transversely extending through an opening in a support, said conductor comprising:

(A) a base portion having an aperture and a piercing tab for contacting a lead wire, said base portion being configured and dimensioned to preclude passage thereof through the support opening, thereby to maintain said base portion below the support; and (B) a transversely extending resiliently flexible strip portion having:

(i) an end immediately extending from said base portion, (ii) an opposed free end, and (iii) an upwardly-projecting, generally convexly curved intermediate segment connecting said strip portion ends, said intermediate segment being biased upwardly by said end immediately extending from said base portion;

said strip portion being cut out of said base portion in a single stamping operation to define said aperture therethrough;

said base portion defining stop means upstanding therefrom for limiting forward movement of said free end, thereby to preclude said strip portion from assuming a flat configuration, said stop means being formed in said single stamping operation, and said base portion and said free end of said strip portion being enlarged in width relative to the support opening, thereby to limit upward movement of said intermediate segment of said flexible strip portion therethrough.

* * * * *